US009605888B2

(12) United States Patent
Shin et al.

(10) Patent No.: US 9,605,888 B2
(45) Date of Patent: Mar. 28, 2017

(54) REFRIGERATOR

(75) Inventors: Jaehoon Shin, Gyeongnam (KR); Yanggyu Kim, Gyeongnam (KR); Yongjoo Park, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 178 days.

(21) Appl. No.: 13/995,530

(22) PCT Filed: Feb. 10, 2012

(86) PCT No.: PCT/KR2012/001029

§ 371 (c)(1),
(2), (4) Date: Jun. 19, 2013

(87) PCT Pub. No.: WO2012/111942

PCT Pub. Date: Aug. 23, 2012

(65) Prior Publication Data

US 2013/0276465 A1 Oct. 24, 2013

(30) Foreign Application Priority Data

Feb. 15, 2011 (KR) ..... 10-2011-0013124

(51) Int. Cl.
*F25D 11/00* (2006.01)
*F25B 21/02* (2006.01)
(Continued)

(52) U.S. Cl.
CPC ..... *F25D 11/00* (2013.01); *F25B 21/02* (2013.01); *F25D 17/065* (2013.01);
(Continued)

(58) Field of Classification Search
CPC .... F25D 25/025; F25D 11/02; F25D 2400/28; F25D 17/065; F25D 17/08; F25B 21/02
(Continued)

(56) References Cited

U.S. PATENT DOCUMENTS 2,932,953 A * 4/1960 Becket ..... F25B 21/02 136/204
2,943,452 A * 7/1960 Buchanan ..... A47J 39/003 62/183
(Continued)

FOREIGN PATENT DOCUMENTS

CN 101642268 A 2/2010
EP 1074802 A2 * 2/2001 ..... F25D 11/02
(Continued)

OTHER PUBLICATIONS

Chinese Search Report dated Sep. 5, 2014 for Chinese Application No. 201280004067.1, with English Translation, 16 Pages.
(Continued)

*Primary Examiner* — Jianying Atkisson
*Assistant Examiner* — Kirstin Oswald
(74) *Attorney, Agent, or Firm* — Fish & Richardson P.C.

(57) ABSTRACT

A refrigerator is provided. In the refrigerator, cool air within the heat exchange chamber is supplied into a drawer assembly disposed inside a storage space, and also the inside of the drawer assembly is cooled using a thermoelectric module to quickly cooling the inside of the drawer assembly. Thus, food storage performance may be improved.

8 Claims, 6 Drawing Sheets

(51) Int. Cl.
*F25D 17/06* (2006.01)
*F25D 25/02* (2006.01)
*F25B 25/00* (2006.01)

(52) U.S. Cl.
CPC ..... *F25D 25/025* (2013.01); *F25B 25/00* (2013.01); *F25D 2317/0681* (2013.01); *F25D 2400/28* (2013.01)

(58) Field of Classification Search
USPC ..... 62/3.6
See application file for complete search history.

(56) References Cited

U.S. PATENT DOCUMENTS 2,970,450 A * 2/1961 Roeder, Jr. ..... F25B 21/02 62/238.2
2,973,627 A * 3/1961 Lackey ..... F25B 21/02 136/204
3,177,671 A * 4/1965 Stambaugh ..... F25B 21/02 136/204
3,194,023 A * 7/1965 Sudmeier ..... F25B 21/02 62/3.62
3,209,547 A * 10/1965 Elfving ..... F25B 21/02 165/104.21
3,241,334 A * 3/1966 Amore ..... 62/382
3,250,433 A * 5/1966 Christine ..... B67D 3/0009 222/131
3,314,242 A * 4/1967 Lefferts ..... F25B 21/02 136/203
3,364,694 A * 1/1968 Cohen ..... F25D 17/065 62/265
3,600,905 A * 8/1971 Dymek ..... F25D 17/045 62/132
3,728,866 A * 4/1973 Layton ..... F24F 3/1405 34/73
4,089,184 A * 5/1978 Beitner ..... F25B 21/02 62/3.62
4,138,857 A * 2/1979 Dankowski ..... B60H 1/3227 248/646
4,326,383 A * 4/1982 Reed ..... F25B 21/02 62/3.62
4,328,676 A * 5/1982 Reed ..... F25B 21/04 62/3.62
4,346,562 A * 8/1982 Beitner ..... F25B 21/02 62/3.61
4,368,622 A * 1/1983 Brooks ..... F25D 17/062 62/157
4,377,935 A * 3/1983 Curtis ..... F25D 17/08 454/100
4,644,753 A * 2/1987 Burke ..... F25B 21/02 62/291
4,722,200 A * 2/1988 Frohbieter ..... F25D 17/065 62/382
4,726,193 A * 2/1988 Burke ..... F25B 21/02 62/354
4,751,826 A * 6/1988 Kawahara ..... F25D 11/02 62/382
4,759,190 A * 7/1988 Trachtenberg ..... B60N 3/103 62/3.62
4,866,945 A * 9/1989 Bender ..... B67D 1/06 222/146.6
4,907,419 A * 3/1990 Kruck ..... F25D 11/00 62/263
5,269,146 A * 12/1993 Kerner ..... F25B 21/02 165/104.33
5,501,076 A * 3/1996 Sharp, III ..... F25B 21/02 62/3.2
5,505,046 A * 4/1996 Nelson ..... F25B 21/02 165/236
5,605,047 A * 2/1997 Park ..... F25B 21/02 62/3.6
5,713,208 A * 2/1998 Chen ..... H01L 35/30 62/3.7
5,784,890 A * 7/1998 Polkinghorne ..... F25B 21/02 165/104.12
5,881,568 A * 3/1999 Kim ..... F25D 17/065 251/253
6,170,276 B1 * 1/2001 Mandel ..... F25D 17/042 62/187
6,370,882 B1 * 4/2002 Adamski ..... F25B 21/04 62/3.6
6,412,286 B1 * 7/2002 Park ..... F25B 21/02 62/3.6
6,418,730 B1 * 7/2002 Tremblay ..... B67D 1/0869 62/3.64
6,484,512 B1 * 11/2002 Anderson et al. ..... 62/3.2
6,530,231 B1 * 3/2003 Nagy ..... F25B 21/02 136/203
6,612,116 B2 * 9/2003 Fu ..... F25D 17/042 62/186
6,625,991 B1 * 9/2003 Clark ..... F25B 21/04 62/3.6
6,675,603 B1 * 1/2004 Lesyna et al. ..... 62/407
6,895,762 B1 * 5/2005 Lin ..... F25B 21/02 62/3.3
7,334,414 B2 * 2/2008 Park ..... A47D 13/00 62/3.3
7,685,837 B2 * 3/2010 Ritchie et al. ..... 62/408
8,028,538 B2 * 10/2011 Kim ..... F25D 17/065 62/187
2003/0084670 A1 * 5/2003 Kim ..... A45D 44/00 62/3.6
2003/0115892 A1 * 6/2003 Fu ..... F25D 17/042 62/187
2003/0226363 A1 * 12/2003 Lee ..... F25D 29/008 62/3.6
2004/0050079 A1 * 3/2004 Holmes ..... F25D 11/02 62/187
2008/0155993 A1 7/2008 Kuehl
2008/0196440 A1 * 8/2008 Kang et al. ..... 62/407
2008/0302114 A1 * 12/2008 Kelly ..... F25D 17/042 62/170
2009/0173100 A1 * 7/2009 Kang ..... F25D 17/08 62/407
2009/0277210 A1 11/2009 Eveland et al.
2010/0071874 A1 * 3/2010 Nojima ..... F25D 17/065 165/61
2010/0154452 A1 * 6/2010 McCann ..... A23B 4/066 62/247
2010/0162745 A1 * 7/2010 Kim ..... F25D 25/025 62/407
2011/0016887 A1 * 1/2011 Lee ..... A23B 7/045 62/3.2

FOREIGN PATENT DOCUMENTS

JP 2000-274913 A 10/2000
JP 2000-320942 A 11/2000
JP 2002-090034 A 3/2002
JP 2004-144365 5/2004
JP 2004-278893 A 10/2004
KR 20-2000-0010950 6/2000
KR 10-0853421 B1 8/2008
KR 10-2004-0067647 7/2014
WO 2009/003893 1/2009

OTHER PUBLICATIONS

PCT International Search Report dated Sep. 5, 2012 for Application No. PCT/KR2012/001029, 3 pages.
Extended European Search Report issued in European Application No. 12746612.6 on Oct. 4, 2016, 7 pages.

* cited by examiner

REFRIGERATOR

CROSS REFERENCE TO RELATED APPLICATIONS

This application is a U.S. National Phase Application under 35 U.S.C. §371 of International Application PCT/KR2012/001029, filed on Feb. 10, 2012, which claims the benefit of Korean Application No. 10-2011-0013124, filed on Feb. 15, 2011, the entire contents of which are hereby incorporated by reference.

TECHNICAL FIELD

The present disclosure relates to a refrigerator.

BACKGROUND ART

Refrigerators are home appliances that can store foods at a low temperature in an inner storage space opened or closed by a door. For this, such a refrigerator cools the inside of the storage space using cool air generated by heat-exchanging with a refrigerant that circulates a cooling cycle to store the foods in an optimum state.

In recent, the size of the refrigerator tends to increase more and more and multifunctions are provided to the refrigerator as dietary life changes and the most elegant is pursued, and accordingly, refrigerators having various structures with consideration of user convenience are coming to the market.

For example, refrigerators for cooling a relatively small space using a thermoelectric module are disclosed in Korean Patent Publication No. 10-2010-0121334, and Korean Patent Publication No. 10-2006-0058350.

However, such a refrigerator may be provided for cooling a relatively small space, and also it may take very long time to realize cryogenic freezing inside the refrigerator.

DISCLOSURE OF INVENTION

Technical Problem

Embodiments provide a refrigerator in which cool air within a heat exchange chamber is supplied into a drawer assembly disposed inside a storage space and cooled by a thermoelectric module to quickly cool the inside of the drawer assembly.

Solution to Problem

In one embodiment, a refrigerator includes: a cabinet defining a storage space; a door opening or closing the storage space; a heat exchange chamber defined in one side of the cabinet, the heat exchange chamber defining a space in which an evaporator for generating cool air is received; a drawer assembly defining a sealed space within the storage space, the drawer assembly communicating with the heat exchange chamber to receive the cool air; and a thermoelectric module disposed in the drawer assembly, the thermoelectric module quickly cooling the inside of the drawer assembly, wherein the thermoelectric module has one side communicating with the heat exchange chamber, and heat generated by radiation of the thermoelectric module is discharged into the heat exchange chamber.

When the cool air within the heat exchange chamber is supplied into the drawer assembly to reach a set temperature, the thermoelectric module may be operated to further cool the inside of the drawer assembly.

A supply duct for supplying the cool air into the drawer assembly and a return duct for guiding air within a heat radiating part into the heat exchange chamber may be disposed between the drawer assembly and the heat exchange chamber, a damper for opening or closing the supply duct may be further disposed on the supply duct, and the damper may be configured to close the supply duct when the thermoelectric device is operated.

The supply duct may pass through a barrier partitioning the storage space into a refrigerating compartment and a freezing compartment.

The supply duct may pass through a grill pan partitioning the storage space and the heat exchange chamber from each other.

The thermoelectric module may include: a heat absorbing part including a heat absorbing-side heatsink and a heat absorbing-side blower fan which discharge the cool air into the drawer assembly to cool the inside of the drawer assembly; a heat radiating part including a heat radiating-side heatsink and a heat radiating-side blower fan which discharge the radiated air into the heat exchange chamber; and an insulation member disposed between the heat absorbing-side heatsink and the heat radiating-side heatsink to contact the thermoelectric device on both side surfaces thereof.

The drawer assembly may include a cool air inlet opened at one side corresponding to the heat absorbing part to allow the cool air within the heat exchange chamber to be introduced into the drawer assembly.

The heat absorbing-side blower fan may be operated when the thermoelectric device is operated and the cool air within the heat exchange chamber is supplied into the drawer assembly.

The drawer assembly may include: a case on which the thermoelectric module is mounted, the case being disposed inside the storage space; and a drawer withdrawably disposed inside the case.

The drawer assembly may include: a case disposed inside the storage space, the case communicating with the heat exchange chamber; and a drawer in which the thermoelectric module is disposed, the drawer being withdrawably disposed inside the case.

The thermoelectric module may further include a cooling plate extending from one side at which heat absorption of the thermoelectric module is performed toward the inside of the storage space of the drawer assembly to perform heat transmitting due to conduction.

The cooling plate may define at least one portion of an inner surface of the storage space of the drawer assembly.

The drawer assembly may be mounted on a barrier which vertically partitions the storage space to define a refrigerating compartment and a freezing compartment.

The drawer assembly may be disposed inside the freezing compartment of the refrigerating and freezing compartments defined in both left and right sides of the storage space to communicate with the heat exchange chamber defined in a rear side of the drawer assembly.

Advantageous Effects of Invention

The refrigerator according to the embodiments has the following effects.

First, the refrigerator according to the embodiments may provide a drawer assembly which is disposed inside the freezing compartment to realize the cryogenic freezing storage having a temperature less than that of the freezing compartment. Thus, more various foods may be effectively stored to improve food storage performance.

Second, in the refrigerator according to the embodiments, the inside of the drawer assembly may communicate with the heat exchange chamber to receive cool air. Thus, the inside of the drawer assembly may be quickly lowered in temperature. Also, the thermoelectric module may be used to cool the inside of the drawer assembly at a lower temperature. Thus, the inner space of the drawer assembly may be cooled at a lower temperature and quickly cooled.

Third, in the refrigerator according to the embodiments, the cooling plate contacting the thermoelectric module may extend into the drawer for receiving foods to define a portion of the bottom surface of the drawer, thereby directly cooling the drawer through the conduction. Thus, the drawer may be directly cooled by the supply of the cool air due to the heat absorbing-side blower fan and the conduction to more quickly cool the space in which the foods are stored.

MODE FOR THE INVENTION

Figure 1:
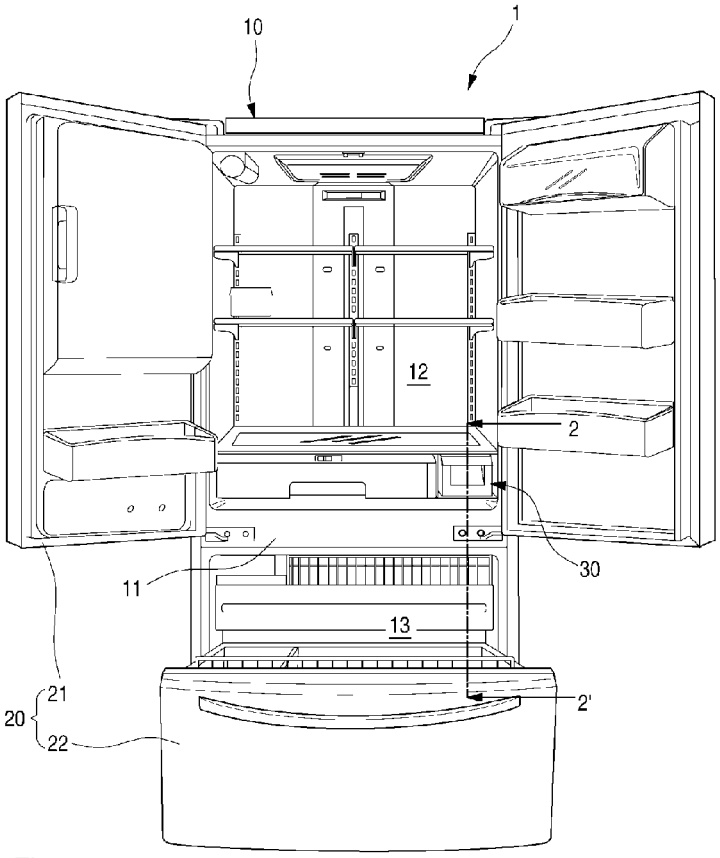
FIG. 1 is a front view of a refrigerator with a door opened according to an embodiment.
Figure 2:
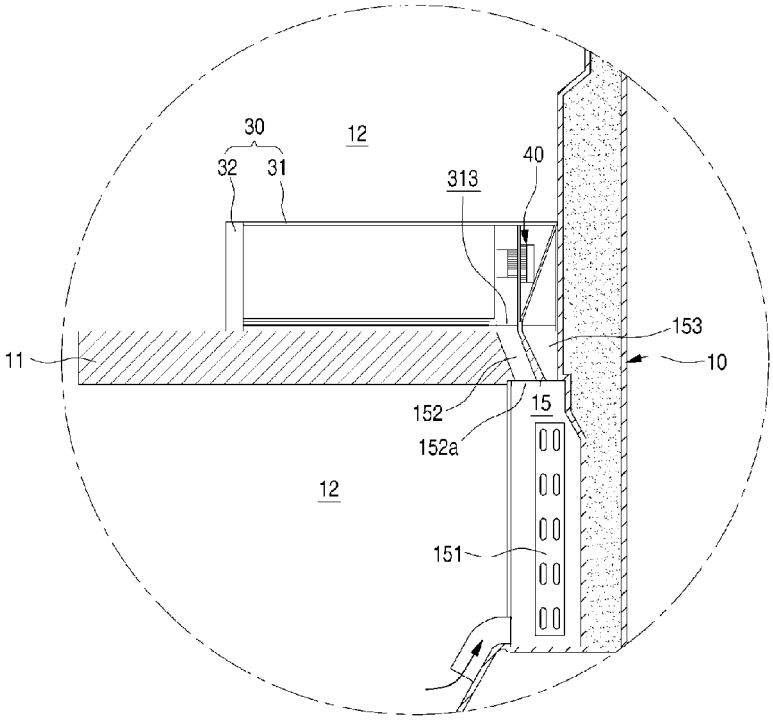
FIG. 2 is a sectional view taken along line 2-2' of FIG. 1.

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art. FIG. 1 is a front view of a refrigerator with a door opened according to an embodiment. FIG. 2 is a sectional view taken along line 2-2' of FIG. 1.

Referring to FIGS. 1 and 2, a refrigerator 1 according to an embodiment includes a cabinet 10 defining a storage space and a door 20 for opening/closing the storage space. Here, an outer appearance of the refrigerator 1 is defined by the cabinet 10 and the door 20.

Also, the storage space inside the cabinet 10 is vertically partitioned by a barrier 11 to define a refrigerating compartment 12 at an upper side and a freezing compartment 13 at a lower side. A heat exchange chamber 15 partitioned from the freezing compartment 13 by a grill pan 14 is defined in a rear side of the freezing compartment 13. An evaporator 151 for generating cool air is disposed within the heat exchange chamber 15.

The cool air generated in the evaporator 151 may be blown by a fan motor and a duct and then supplied into the freezing compartment 13 or the refrigerating compartment 12. Also, the cool air generated in the evaporator 151 may be supplied into a drawer assembly (that will be described below) through a supply duct 152 and a return duct which will be described below in detail.

The door 20 may include a refrigerating compartment door 21 and a freezing compartment door 22 which respectively and selectively open or close the refrigerating compartment 12 and the freezing compartment 13. The refrigerating compartment door 21 is provided in a pair on left and right sides. The refrigerating compartment door 21 may be hinge-coupled to the cabinet 10 to open or close the refrigerating compartment 12 by rotation thereof. The freezing compartment door 22 may be withdrawable in a drawer type. Thus, the freezing compartment 13 may be opened or closed by the withdrawal of the freezing compartment door 22.

A plurality of shelves and drawers are disposed inside the freezing compartment 12 and the refrigerating compartment 13 to receive various foods. A drawer assembly 30 for quick freezing or cryogenic freezing storage of foods is disposed inside the refrigerating compartment 12.

The drawer assembly 30 is disposed on a bottom surface of the refrigerating compartment 12, i.e., a top surface of the barrier 11. When the refrigerating compartment door 21 is opened, a front surface of the drawer assembly 30 is exposed. The drawer assembly 30 may include a case 31 and a withdrawable drawer 32 disposed inside the case 31.

The drawer assembly 30 and the heat exchange chamber 15 are connected to each other by a supply duct 152. The supply duct 152 has one end communicating with the heat exchange chamber 15 and the other end communicating with one side of the case 31. Thus, the supply duct 152 provides a passage through which cool air within the heat exchange chamber 15 is supplied into the drawer assembly 30.

The drawer assembly 30 and the heat exchange chamber 15 or the freezing compartment 13 are connected to each other by the return duct 153. The return duct 153 may have one end communicating with one side of the case 31 and the other end communicating with the heat exchange chamber 15 or the freezing compartment 13.

A damper 153 may be disposed in the supply duct 152 and the return duct 153. Thus, the cool air may be selectively supplied into the drawer assembly 30. A fan motor may be further disposed in the supply duct 152 and the return duct 153. Thus, the cool air may be circulated between the drawer assembly 30 and the freezing compartment 13 or the heat exchange chamber 15 by the operation of the fan motor.

Hereinafter, the drawer assembly will be described in more detail with reference to the accompanying drawings.

Figure 3:
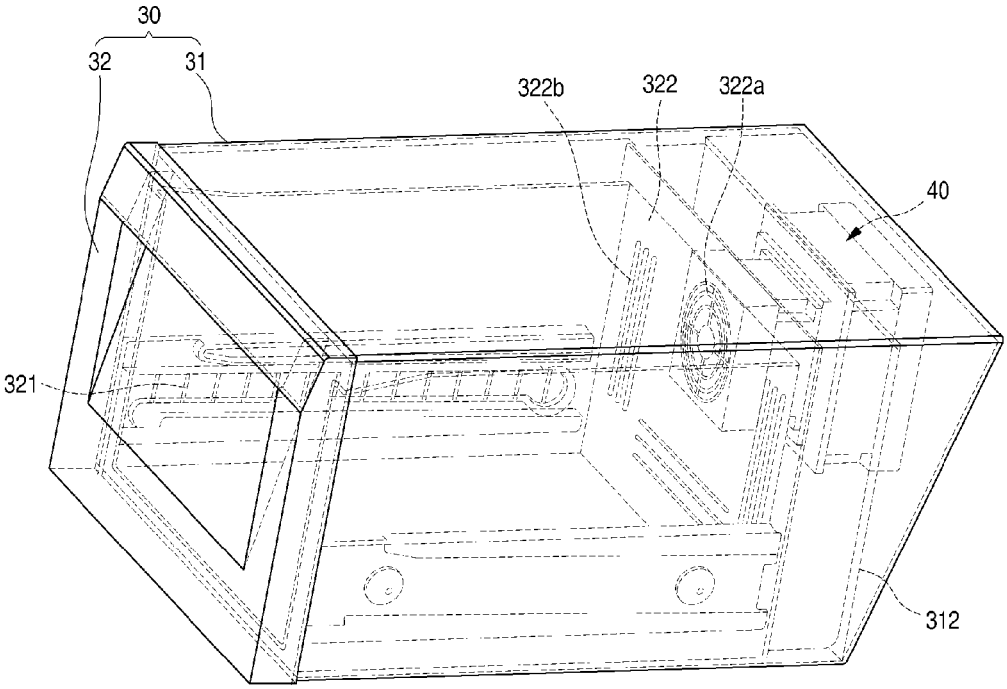
FIG. 3 is a perspective view of a drawer assembly according to an embodiment.
Figure 4:
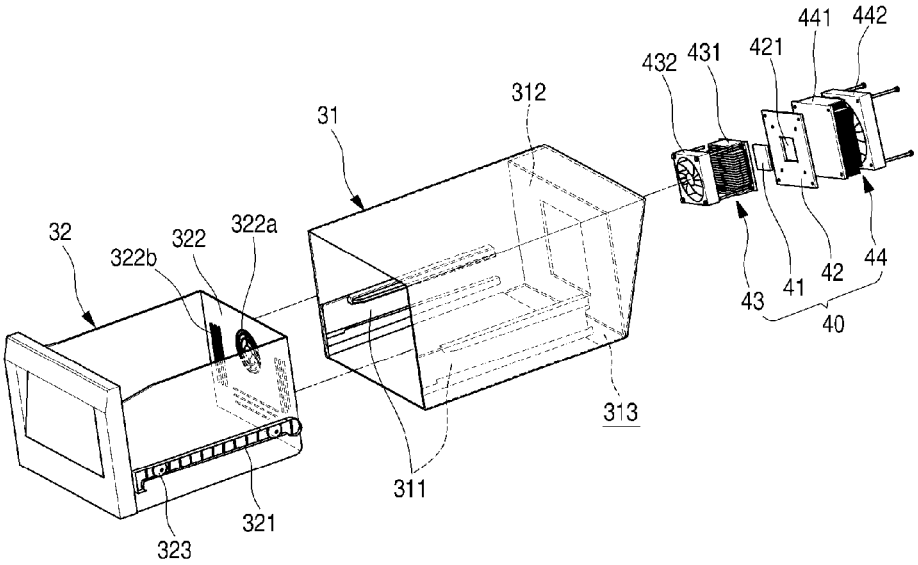
FIG. 4 is an exploded perspective view of the drawer assembly.

FIG. 3 is a perspective view illustrating the drawer assembly according to an embodiment. FIG. 4 is an exploded perspective view of the drawer assembly.

Referring to FIGS. 3 and 4, the drawer assembly 30 includes a case 31 defining an outer appearance of the drawer assembly 30 and a space opened in a front direction, a drawer 32 withdrawably disposed inside the case 31, and a thermoelectric module 40 for cooling the inside of the drawer assembly 30.

In detail, the case 31 has a rectangular parallelepiped shape with front and rear surfaces opened. Also, the case 31 extends from a front end of the refrigerating compartment 12 up to a rear end. Thus, the opened rear surface of the case 31 may be blocked by a rear sidewall of the refrigerating compartment 12.

The drawer 32 is disposed at a front portion of the case 31. The drawer 32 may be withdrawably disposed inside the case 31. A slide guide 321 and a roller 323 are disposed on both left and right side surfaces of the drawer 32. The slide guide 321 and the roller 323 may be moved along a guide part 311 disposed on an inner surface of the case 31 to allow the drawer 32 to be smoothly withdrawn.

Also, a grill pan 323 is disposed on a rear surface of the drawer 32. The grill pan 322 provides a passage through which cool air generated in the thermoelectric module 40 and cool air supplied from the heat exchange chamber 15 are introduced. Thus, the cool air within the drawer 32 may be uniformly introduced into the drawer 32. A grill may include a center grill 322*a* disposed on a center of a rear sidewall of the drawer 32 corresponding to a heat absorbing-side blower fan 432 disposed in the thermoelectric module 40 and a side grill 322*b* vertically and horizontally disposed on outer upper and lower and left and right ends away from the center of the rear sidewall of the drawer 32.

A thermoelectric module mounting part 312 on which the thermoelectric module 40 is mounted is disposed on a rear portion of the case 31. An insulation member 42 constituting the thermoelectric module 40 may be fixed and mounted on the thermoelectric module mounting part 312. The thermoelectric module mounting part 312 may be integrally manufactured together with the case 31. Alternatively, the thermoelectric module mounting part 312 may be separately manufactured using a material different from that of the thermoelectric module 40 and then mounted on the thermoelectric module 40.

A cool air inlet 313 connected to the supply duct 152 is disposed and opened in one side of the case 31 corresponding to a front side of the insulation member 42. The cool air inlet 313 is disposed between the rear sidewall of the drawer 32 and the insulation member 42 in a state where the drawer 32 completely takes in. Also, a grill may be further disposed on the cool air inlet 313 to prevent foreign substances from being introduced.

A rear surface of the case 31 corresponding to a rear side of the insulation member 42 is opened and connected to the return duct 153. Thus, heat radiated from a heat radiating part 44 of the thermoelectric module 40 may be introduced into the heat exchange chamber 15 or the freezing compartment 13 through the return duct 153 and thus be cooled. Alternatively, the return duct 153 may communicate with a space corresponding to the front side of the insulation member 42. Also, the return duct 153 may circulate cool air within the drawer assembly 30.

Also, a damper 152*a* may be further disposed in the supply duct 152. The damper 152*a* may close the supply duct 152 to prevent cool air from being introduced into the heat exchange chamber 14 when a thermoelectric device of the thermoelectric module 40 is operated.

Hereinafter, the thermoelectric module will be described in more detail.

The thermoelectric module 40 may include the thermoelectric device 41, the insulation member 42, a heat absorbing part 43, and the heat radiating part 44.

The thermoelectric device 41 may be a Peltier device in which one surface thereof absorbs heat and the other surface radiates heat by a semiconductor carrier when a current flows into a semiconductor (or conductor). A heatsink plate and a blower fan may be respectively disposed on side surfaces to effectively absorb and radiate heat. The thermoelectric device 41 may be mounted on a punched mounting part 421 of the insulation member 42. Also, both surfaces of the thermoelectric device 41 may contact the heat absorbing part 43 and the heat radiating part 44.

The thermoelectric device 41 may be operated only when an internal temperature of the drawer assembly 30 is less than a set temperature. That is, when the drawer assembly 30 is initially cooled, cool air within the heat exchange chamber 15 is supplied from the supply duct 152 to primarily cool the inside of the drawer assembly 30. When the internal temperature of the drawer assembly 30 reaches the set temperature, the supply of the cool air of the heat exchange chamber 15 is stopped, and the thermoelectric device 41 is operated to secondarily cool the inside of the drawer assembly 30.

The insulation member 42 may have an insulating sheet or plate shape. Thus, the insulation member 42 may partition the inside of the case 31 into front and rear sides. When the thermoelectric module mounting part 312 partitioning the inside of the case 31 is further disposed, the insulation member 42 may be mounted on the thermoelectric module mounting part 312. The insulation member 42 may have a thickness corresponding to that of the thermoelectric device 41, or the heat absorbing part 43 and the heat radiating part 44 may contact front and rear surfaces of the thermoelectric device 41.

The heat absorbing part 43 may be disposed at a front side of the insulation member 42. Also, the heat absorbing part 43 may include a heat absorbing-side heatsink 431 and a heat absorbing-side blower fan 432. The heat absorbing-side heatsink 431 may contact a front surface of the insulation member 42 to increase the heat exchange of the insulation member 42.

Also, the heat absorbing-side blower fan 432 is disposed at a front side of the heat absorbing-side heatsink 431. Also, the heat absorbing-side blower fan 432 may be fixed to one side of the heat absorbing-side heatsink 431. Also, the heat absorbing-side blower fan 432 may forcibly blow the cool air generated in the heat absorbing-side heatsink 431 toward the drawer 32 to effectively cool the drawer assembly 30.

Also, when a separate fan is not provided to the supply duct 152, the heat absorbing-side heatsink 431 may be operated to smoothly supply the cool air through the supply duct 152. That is, even though the thermoelectric device 41 is not operated, when the supply of the cool air into the drawer assembly 30 is required, the heat absorbing-side blower fan 432 may be operated.

The heat radiating part 44 may be disposed at a rear side of the insulation member 42. Also, the heat radiating part 44 may include a heat radiating-side heatsink 441 and a heat radiating-side blower fan 442. The heat radiating-side heatsink 441 and the heat radiating-side blower fan 442 may have fundamental structures and shapes similar to those of the heat absorbing-side heatsink 431 and the heat absorbing-side blower fan 432, respectively.

However, the heat radiating-side heatsink 441 may contact a rear surface of the thermoelectric device 41 and have a size greater than that of the heat absorbing-side heatsink 431 to relatively increase heat-exchange efficiency. Also, the heat radiating-side blower fan 442 may have a size corresponding to that of the heat radiating-side heatsink 441 and be coupled to a rear portion of the heat radiating-side heatsink 441.

Hereinafter, an operation for cooling the inside of the drawer assembly of the refrigerator having the above-described structure according to the embodiment will be described.

First, a user opens the refrigerating compartment door 21 so as to receive foods into the drawer assembly 30. Then, the drawer 32 is withdrawn to take the foods to be stored in a cryogenic freezing state into the drawer 32.

When the drawer 32 takes in and then the refrigerating compartment door 21 is closed, cool air within the heat exchange chamber 15 is introduced into the case 31 along the supply duct 152 to cool the inside of the case 31. Here, the cool air supplied along the supply duct 152 may be supplied into the case 31 by a blower fan (not shown) disposed inside the heat exchange chamber 15 or the blower fan disposed inside the refrigerator. As necessary, the heat absorbing-side blower fan 432 may be operated to smoothly supply cool air into the drawer 32. When the return duct 153 communicates with a space in which the drawer 32 is disposed, the cool air heat-exchanged within the drawer 32 may be discharged into the heat exchange chamber 15 or the freezing compartment 13 through the return duct 153. The cool air within the heat exchange chamber 15 may be continuously supplied to primarily cool the inside of the drawer assembly 30 until the internal temperature of the drawer assembly 30 reaches the set temperature.

When the internal temperature of the drawer assembly 30 reaches the set temperature, the damper 152*a* of the supply duct 152 is closed to prevent the cool air within the heat exchange chamber 15 from being supplied into the drawer assembly 30.

When the damper 152*a* is closed, an operation of the thermoelectric device 41 may start at the same time. The cool air generated in the heat absorbing-side heatsink 431 may be smoothly supplied into the drawer 32 via the grill pan 323 by the heat absorbing-side blower fan 432. The thermoelectric device 41 may be operated until the internal temperature of the drawer assembly 30 reaches a set temperature for cryogenic freezing to continuously cool the inside of the drawer assembly 30.

Since the thermoelectric device 41 is operated, the heat radiating-side heatsink may radiate heat. Also, the heat radiating-side blower fan 442 may be operated to enhance heat exchange of the heat radiating-side heatsink 441. Since the heat radiating-side blower fan 442 is operated, high-temperature air in a rear side of the case 31 may be introduced into the heat exchange chamber 15 or the freezing compartment 13 through the return duct 153 and thus cooled by cool air within the heat exchange chamber 15 or the freezing compartment 13.

Various embodiments except for the above-described embodiment may be applied to the cooling device according to the current embodiment. Hereinafter, a cooling device according to another embodiment will be described.

In a refrigerator according to another embodiment, a cooling plate may be disposed on a thermoelectric module to further cool the inside of a drawer in a direct cooling manner, and also the thermoelectric module may be disposed in the drawer. Thus, the refrigerator according to another embodiment may be equal to the refrigerator according to the foregoing embodiment except for a structure of a drawer assembly. Accordingly, the same part will be designated by the same reference numeral and detailed descriptions thereof will be omitted.

Figure 5:
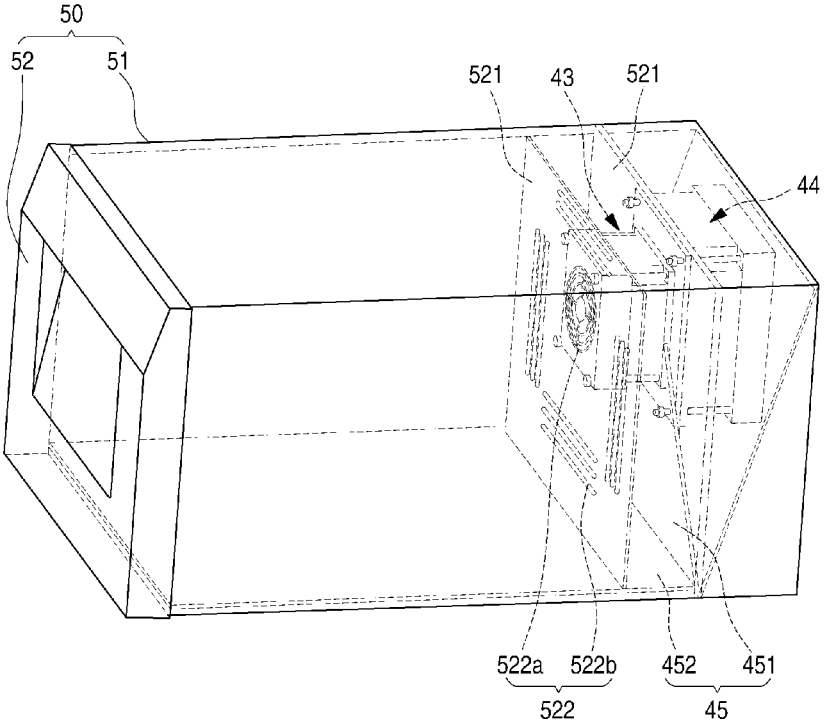
FIG. 5 is a perspective view of a drawer assembly according to another embodiment.
Figure 6:
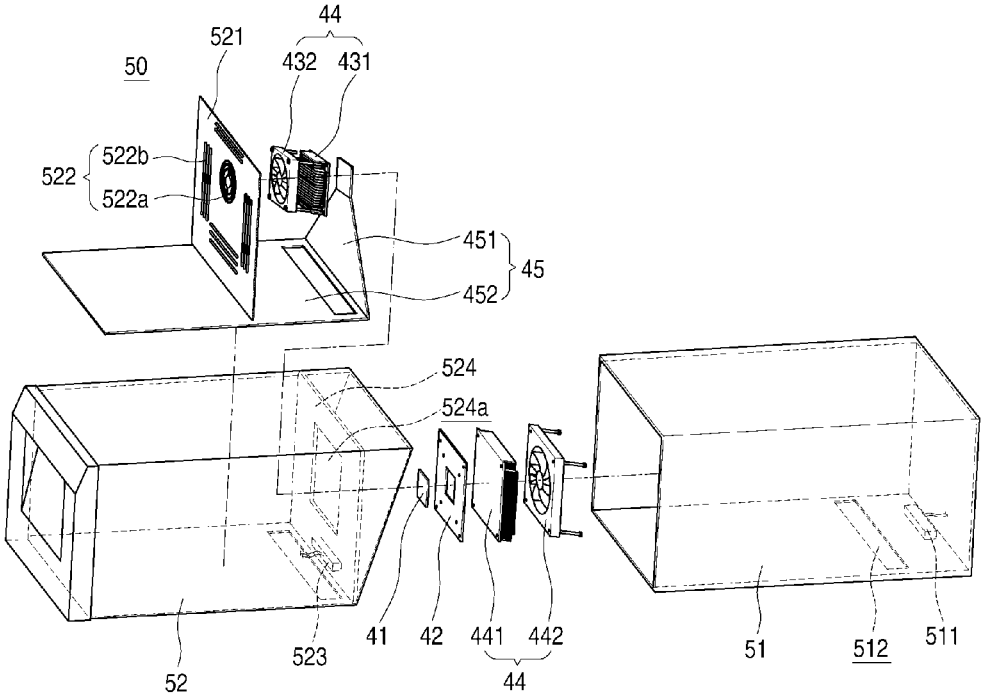
FIG. 6 is an exploded perspective view of the drawer assembly.

FIG. 5 is a perspective view of a drawer assembly according to another embodiment. FIG. 6 is an exploded perspective view of the drawer assembly.

Referring to FIGS. 5 and 6, a drawer assembly 50 according to another embodiment may include a case 51 defining an outer appearance thereof and a drawer 52 withdrawably disposed in the case 51.

The case 51 may extend from a front end of a refrigerating compartment 12 to a rear end. A front surface of the case 51 may be covered when the drawer 52 takes in. A rear surface of the case 51 may be closed by a rear sidewall of the refrigerating compartment 12.

A partition plate 521 for partitioning the inner space of the drawer 52 into a space in which foods are received and a space in which a thermoelectric module 40 is mounted may be further disposed inside the drawer 52. Also, a grill 522 for guiding cool air into a front space in which the foods are received may be further disposed on the partition plate 521.

A grill 522 may include a center grill 522*a* disposed on a center of the rear sidewall of the drawer 52 corresponding to a heat absorbing-side blower fan 432 disposed in the thermoelectric module 40 and a side grill 522*b* vertically and horizontally disposed on outer upper and lower and left and right ends away from the center of the rear sidewall of the drawer 52.

Also, the thermoelectric module 40 is disposed at a rear side of the partition plate 521. The thermoelectric module 40 may be disposed at the rear side of the partition plate 521 and mounted on a rear sidewall of a thermoelectric module mounting part 524 partitioning the inside of the drawer 52 into front and rear sides. A mounting hole 524*a* having a shape corresponding so that an insulation member 42 on which a thermoelectric device 41 is mounted is mounted may be punched in the thermoelectric module mounting part 524.

The thermoelectric module 40 may include the insulation member 42, a heat absorbing part 43, a heat radiating part 44, and a cooling plate 45. Fundamental structures and shapes of the thermoelectric device 41, the insulation member 42, the heat absorbing part 43, and the heat radiating part 44 have the same structure and effect as those of the foregoing embodiment except that they are mounted on the drawer 52. Thus, their detailed description will be omitted. However, the insulation member 42 on which the thermoelectric device 41 is mounted may be mounted on the rear sidewall of the drawer 52. Also, as necessary, the insulation member 42 may be disposed on the entire rear sidewall of the drawer 52.

A cooling plate 45 is disposed between the thermoelectric device 41 and the heat absorbing-side heatsink 431. That is, the cooling plate 45 may contact a front surface of the thermoelectric device 41 and a rear surface of the heat absorbing heatsink 431 to allow heat of the thermoelectric device 41 to be transmitted into the cooling plate 45 by conduction. The cooling plate 45 may extend into the drawer 52 to directly cool the inside of the drawer 52 by the conduction. Thus, the cooling plate 45 may be formed of a metal material having superior thermal conductivity.

Also, the cooling plate 45 may include a contact part disposed between the thermoelectric device 41 and the heat absorbing-side heatsink 431 and an extension part 452 extending into the drawer 52. In detail, the contact part 451 has one side having a size and shape corresponding to those of the thermoelectric device 41 to effectively transmit heat of the thermoelectric device 41. Also, the contact part 451 may extend downward up to a bottom surface of the drawer 52. The extension part 452 may extend forward from a lower end of the contact part 451 to define an entire bottom surface of the drawer 52. Thus, the entire bottom surface of the drawer 52 may be cooled by the cooling plate 45, and the foods within the drawer 52 may be directly cooled. Alternatively, the cooling plate 45 may define a portion of the bottom surface of the drawer 52, but the entire bottom surface of the drawer 52. Also, the cooling plate 45 may define a side surface of the drawer 52, but the bottom surface of the drawer 52.

Connectors 523 and 511 for supplying a power into the thermoelectric module 40 may be disposed on one side of the drawer 52 and one side of the case 51, respectively. The connectors 523 and 511 may be connected to each other in a state where the drawer 52 completely takes in. When the connectors 523 and 511 are connected to each other, the thermoelectric module 40 may be operated.

Also, a cool air inlet 512 may be disposed on one side surface of the case 51 and connected to a supply duct 152. The cool air inlet 512 may be disposed between a partition plate 521 and a thermoelectric module mounting part 524. Also, the bottom surface of the drawer 52 and a bottom surface of the cooling plate 45 which correspond to the cool air inlet 512 may be opened with shapes corresponding to each other.

Thus, the inside of the drawer 52 may be primarily cooled by cool air within the heat exchange chamber 15. Also, a rear surface of the case 51 may be connected to a return duct 153 to discharge air heated by the heat radiating part 44 into the heat exchange chamber 15 or the freezing compartment 13, thereby cooling the air.

Also, another embodiment except for the above-described embodiments may be applied to the cooling device according to the current embodiment. Hereinafter, a cooling device according to another embodiment will be described.

In the refrigerator according to another embodiment, a drawer assembly cooled by the supply of cool air and a thermoelectric module is disposed inside a freezing compartment. Thus, the refrigerator according to another embodiment may be equal to the refrigerator according to the foregoing embodiments except for a mounted position of the drawer assembly. Accordingly, the same part will be designated by the same reference numeral and detailed descriptions thereof will be omitted.

Figure 7:
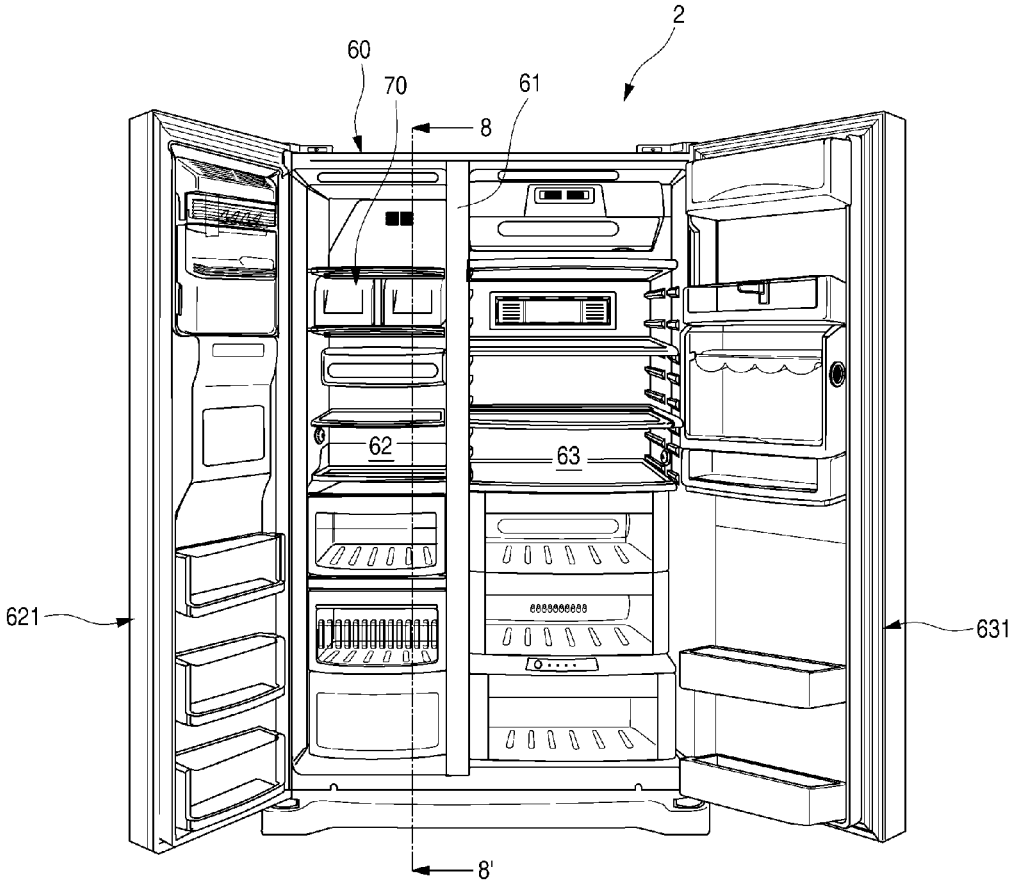
FIG. 7 is a front view of a refrigerator with a door opened according to another embodiment.
Figure 8:
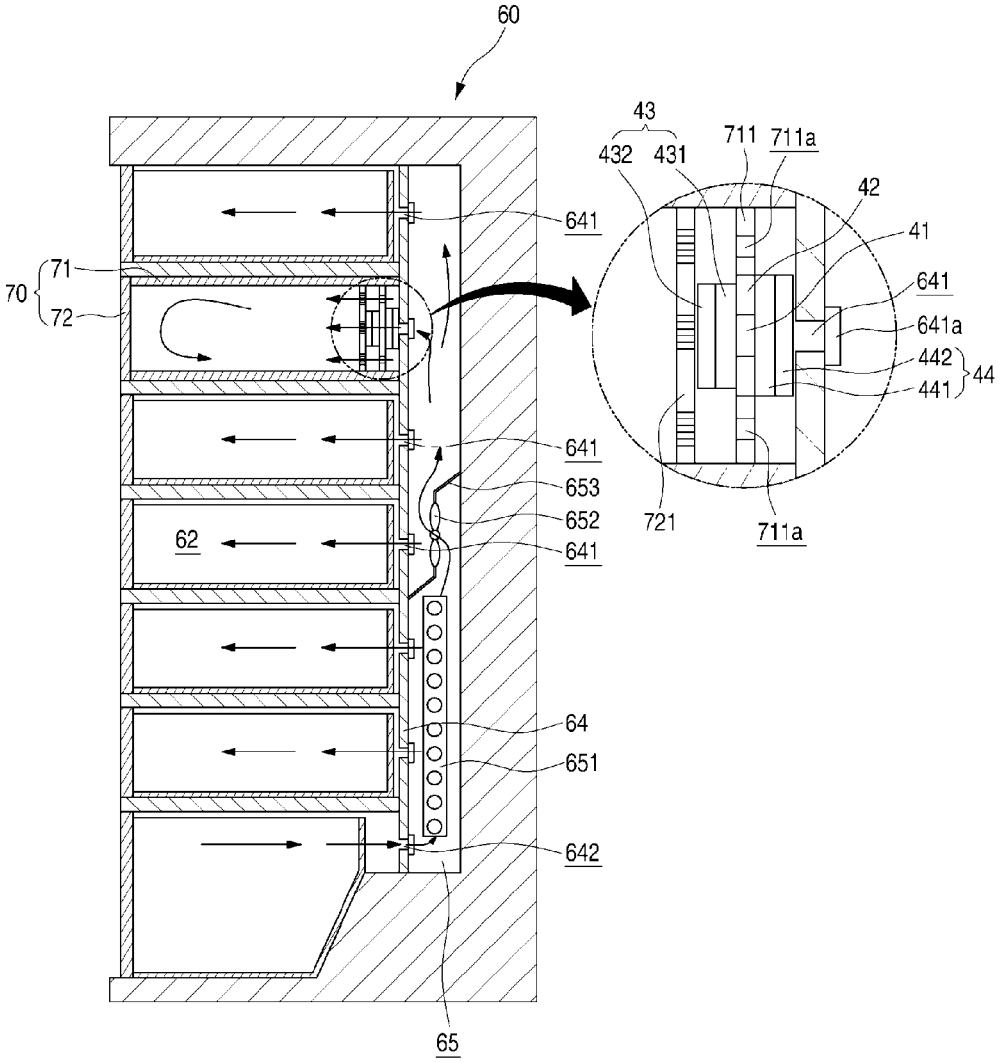
FIG. 8 is a sectional view taken along line 8-8' of FIG. 7.

FIG. 7 is a front view of a refrigerator with a door opened according to another embodiment. FIG. 8 is a sectional view taken along line 8-8' of FIG. 7.

Referring to FIGS. 7 and 8, a cabinet 60 of a refrigerator 2 according to another embodiment is partitioned into left and right sides by a barrier 61 to define a freezing compartment 62 and a refrigerating compartment 63. A plurality of shelves and drawers may be provided within the refrigerating compartment 63 and the freezing compartment 62. Specifically, a drawer assembly 70 that will be described below may be disposed inside the freezing compartment 62. Also, the freezing compartment 62 and the refrigerating compartment 63 may be opened or closed by a freezing compartment door 621 and a refrigerating compartment door 631.

Also, a heat exchange chamber 65 partitioned by a grill pan 64 is defined at a rear side of the freezing compartment 62. An evaporator 651 may be disposed within the heat exchange chamber 65 to generate cool air. A blower fan 652 a shroud 653 which circulate and supply the cool air may be further disposed above the evaporator 651.

Also, a plurality of cool air outlets 641 for supplying cool air into the freezing compartment 62 may be disposed in the grill pan 64. A cool air inlet 642 through which the cool air within the freezing compartment 62 is introduced again into the heat exchange chamber 65 may be disposed in a lower end of the grill pan 64 to supply and circulate the cool air into the freezing compartment 62 and the drawer assembly 70.

Also, a damper 641*a* may be disposed on the grill pan 64 to selectively supply the cool air within the heat exchange chamber 65 into the refrigerating compartment 63 and the drawer assembly 70.

The drawer assembly 70 may store foods received therein in a cryogenic freezing state. The drawer assembly 70 may be disposed on one side of the freezing compartment 62 corresponding to the cool air outlet 641. The drawer assembly 70 may include a case 71 defining an outer appearance thereof and a drawer 72 withdrawably disposed inside the case 71.

Also, a thermoelectric module 40 may be disposed on one side of the case 71 corresponding to a rear side of the drawer 72. The thermoelectric module 40 may have the same constitution as that of the forgoing embodiment. That is, the thermoelectric module 40 may include a thermoelectric device 41, an insulation member 42 mounted on the thermoelectric device 41, a heat absorbing part 43 including a heat absorbing-side heatsink 431 and a heat absorbing-side blower fan 432, and a heat radiating part 44 including a heat radiating-side heatsink 441 and a heat radiating-side blower fan 442.

Here, the heat absorbing part 43 may be disposed to face the drawer to blow cool air toward the drawer 72. Here, the blown cool air may be smoothly supplied into the drawer 72 through a grill 721 disposed on a rear surface of the drawer 72. The heat radiating part 44 may communicate with the heat exchange chamber 65 to allow the cool air radiated from the heat radiating part 44 to be cooled within the heat exchange chamber 65.

A thermoelectric module mounting part 711 partitioning the inside of the case 71 into a space in which the drawer 72 is disposed and a space in which the thermoelectric module 40 is disposed may be disposed in the case 71. Also, an insulation member 42 of the thermoelectric module 40 may be fixed to the thermoelectric module mounting part 711. Thus, the thermoelectric module 40 may be mounted on the thermoelectric module mounting part 711. Also, a cool air inlet 711*a* communicating with the cool air outlet 641 of the heat exchange chamber 65 may be disposed in the thermoelectric module mounting part 711. Also, a damper 641*a* may be disposed on the cool air outlet 641 corresponding to the drawer assembly 70 to selectively introduce the cool air supplied from the heat exchange chamber 65 into the drawer 72. When the cool air outlet 641 and the cool air inlet 711 are spaced from each other, the cool air outlet 641 and the cool air inlet 711 may be connected to each other through a separate passage.

The damper 641*a* may be opened only when the thermoelectric device 41 is not operated. Thus, the inside of the drawer 72 may be primarily cooled by the cool air within the heat exchange chamber 65 and then secondarily cooled by the thermoelectric module 40.

INDUSTRIAL APPLICABILITY

According to the current embodiments, the inner space of the drawer assembly may be cooled at a lower temperature and quickly cooled to improve storage performance. Thus, industrial applicability may be further enhanced.

The invention claimed is:

1. A refrigerator comprising:

a cabinet defining:

a refrigerating compartment;

a freezing compartment that is located below the refrigerating compartment; and a barrier that extends horizontally and is configured to partition the refrigerating compartment and the freezing compartment;

a heat exchange chamber that is located behind the freezing compartment and that is configured to receive an evaporator that is configured to generate cool air;

a drawer assembly disposed on the barrier, configured to be received in the refrigerating compartment, and defining a sealed space at a temperature lower than a temperature of the freezing compartment, the drawer assembly including:

a case;

a drawer that is located in the case; and a thermoelectric module mounting part that is located between a rear surface of the drawer and a rear surface of the case and that defines a hole, wherein the rear surface of the drawer and the thermoelectric module mounting part define a heat absorbing space, and wherein the thermoelectric module mounting part and the rear surface of the case define a heat radiating space;

a thermoelectric module that is located in the drawer assembly and that is configured to cool air in the drawer assembly, the thermoelectric module including:

an insulation member that is located in the hole of the thermoelectric module mounting part and that defines an opening;

a thermoelectric device that is located in the opening of the insulation member and that has a heat absorbing surface and a heat radiating surface;

a heat absorbing-side heat sink that contacts the heat absorbing surface of the thermoelectric device;

a heat absorbing-side blower fan that is configured to cool air inside the drawer assembly by discharging cool air into the drawer;

a heat radiating-side heat sink that contacts the heat radiating surface of the thermoelectric device; and a heat radiating-side blower fan that is configured to discharge air radiated by the heat radiating-side heat sink into the heat exchange chamber;

a supply duct that connects the heat exchange chamber and the heat absorbing space, that passes through the barrier, and that is configured to supply cool air into the heat absorbing space;

a return duct that connects the heat radiating space and the heat exchange chamber, that passes through the barrier, and that is configured to guide radiated air into the heat exchange chamber; and a damper that is configured to open or close the supply duct, wherein the rear surface of the drawer includes:

a center grill that is located in a center of the rear surface of the drawer and that is adjacent to the heat absorbing-side blower fan; and a side grill that is separated from the center grill, wherein the heat exchange chamber is configured to supply cool air into the drawer assembly through the side grill and the damper is configured to open the supply duct based on a temperature inside the drawer assembly being below a set temperature, wherein, based on the temperature inside the drawer being at or above the set temperature:

the damper is configured to close the supply duct, the heat-absorbing side heat sink is configured to cool air in the heat absorbing space, and the heat-absorbing side blower fan is configured to circulate air from the drawer, through the side grill, to the heat-absorbing space, through the center grill, and wherein the drawer assembly is configured to directly return cool air that is supplied from the heat exchange chamber through the supply duct to the heat exchange chamber without mixing with cool air in the refrigerating compartment.

2. The refrigerator of claim 1, further comprising a cool air inlet that is located in a bottom of the case and that is adjacent to an outlet of the supply duct.

3. The refrigerator of claim 2, further comprising a cooling plate that is located between the thermoelectric device and the heat absorbing-side heat sink and that includes:

a contact part that contacts the heat absorbing surface and that extends down to the bottom of the case; and an extension part that extends forward from a lower end of the contact part.

4. The refrigerator of claim 3, wherein the extension part extends along the bottom of the case and is about a same size as the bottom of the case.

5. The refrigerator of claim 4, further comprising a cool air inlet that is located in the extension part and that is adjacent to the cool air inlet of the case.

6. The refrigerator of claim 1, wherein:

the rear surface of the drawer includes at least two additional side grills that are located around the center grill, and the heat exchange chamber is configured to supply cool air into the drawer assembly through the at least two additional side grills and the damper is configured to open the supply duct based on a temperature inside the drawer assembly being below a second set temperature, and based on the temperature inside the drawer being at or above the second set temperature:

the damper is configured to close the supply duct, the heat-absorbing side heat sink is configured to cool air in the heat absorbing space, the heat-absorbing side blower fan is configured to circulate air from the drawer, through the at least two additional side grills, to the heat-absorbing space, through the center grill, and to the drawer.

7. The refrigerator of claim 1, wherein the center grill is circular and the side grill is rectangular.

8. The refrigerator of claim 1, wherein:

the drawer is configured to move in and out of the case, and the thermoelectric module is attached to the case.

* * * * *